US006845758B2

(12) United States Patent
Seymour, II et al.

(10) Patent No.: US 6,845,758 B2
(45) Date of Patent: Jan. 25, 2005

(54) FUEL INJECTOR RETAINER ASSEMBLY

(75) Inventors: Kenneth R. Seymour, II, Villa Park, IL (US); James H. Yager, St. Charles, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 33 days.

(21) Appl. No.: 10/368,724

(22) Filed: Feb. 19, 2003

(65) Prior Publication Data

US 2004/0159310 A1 Aug. 19, 2004

(51) Int. Cl.[7] ..... F02M 37/00
(52) U.S. Cl. ..... 123/470; 123/509
(58) Field of Search ..... 123/509, 470, 123/508, 507, 445; 239/600, 88–96

(56) References Cited

U.S. PATENT DOCUMENTS

| | | | | | |
|---|---|---|---|---|---|
| 1,793,234 | A | * | 2/1931 | Mahler | 123/468 |
| 2,777,431 | A | * | 1/1957 | Meurer | 123/470 |
| 4,066,213 | A | * | 1/1978 | Stampe | 239/533.3 |
| 4,133,321 | A | * | 1/1979 | Hofmann et al. | 123/470 |
| 5,460,329 | A | | 10/1995 | Sturman | |
| 5,682,858 | A | | 11/1997 | Chen et al. | |
| 5,697,345 | A | * | 12/1997 | Genter et al. | 123/470 |
| 5,785,024 | A | * | 7/1998 | Takei et al. | 123/470 |
| 5,960,774 | A | * | 10/1999 | Norgauer et al. | 123/470 |
| 6,009,856 | A | | 1/2000 | Smith, III et al. | |
| 6,026,786 | A | * | 2/2000 | Groff et al. | 123/501 |
| 6,196,195 | B1 | * | 3/2001 | Trutschel et al. | 123/470 |
| 6,499,468 | B1 | * | 12/2002 | Ferraro et al. | 123/470 |
| 6,684,860 | B2 | * | 2/2004 | Baessler et al. | 123/470 |

* cited by examiner

*Primary Examiner*—Carl S. Miller
(74) *Attorney, Agent, or Firm*—Dennis Kelly Sullivan; Susan L. Lukasik; Jeffrey P. Calfa

(57) ABSTRACT

A fuel injector is operably couplable to a cylinder head, a clamping mechanism being in operable engagement with the fuel injector and the cylinder head for exerting a clamping force tending to hold the fuel injector in engagement with the cylinder head and includes a retainer assembly for retaining the fuel injector in operable coupling with a cylinder head, the retainer acting in cooperation with the clamping mechanism. The retainer assembly has a split dowel, the split dowel being statically engagable with the cylinder head by a clamping action of the clamping mechanism acting on the fuel injector and being engagable with a spring component for imparting a bias to the spring component. The spring component is in operable engagement with the fuel injector for imparting a reactive force to the fuel injector responsive to the bias imparted by the split dowel. And further including a friction coupling, the friction coupling fluidly coupling the split dowel and the fuel injector for generating a frictional force between the split dowel and the fuel injector, the frictional force tending to resist motion of the fuel injector relative to the cylinder head. A retainer assembly as indicated above and a method of resisting relative motion between a fuel injector and a cylinder head are further included.

30 Claims, 3 Drawing Sheets

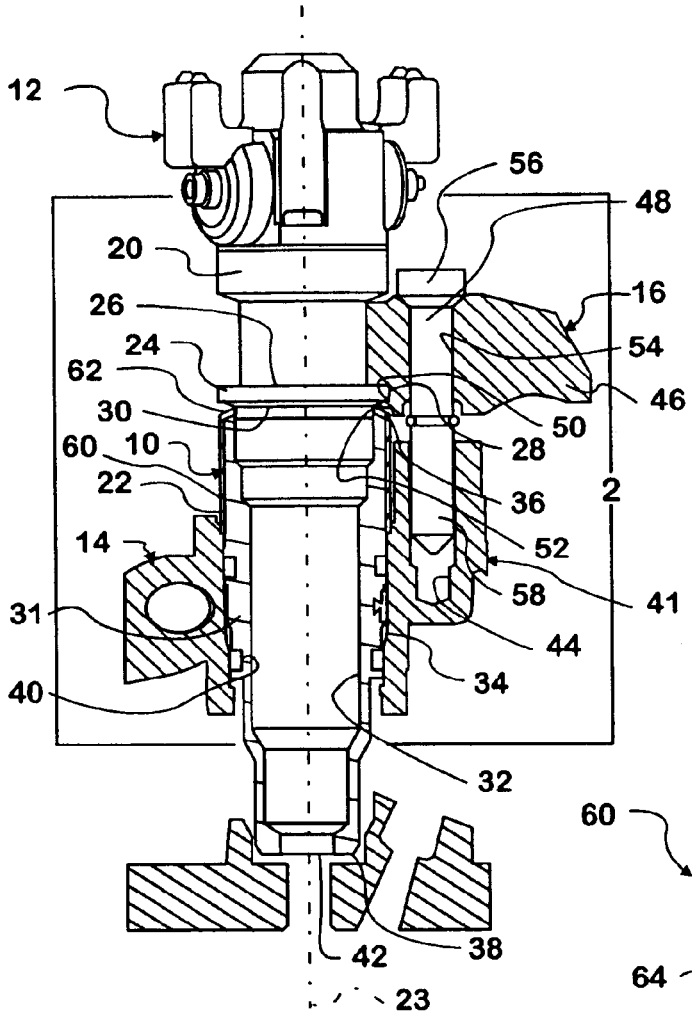
FIG. 1
FIG. 6
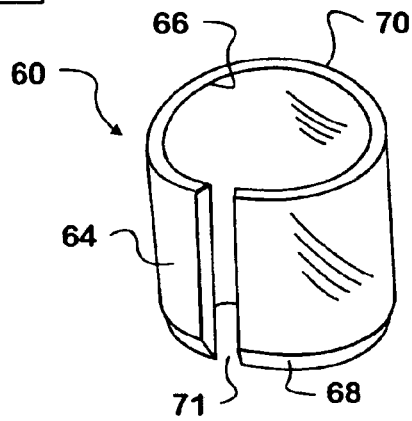
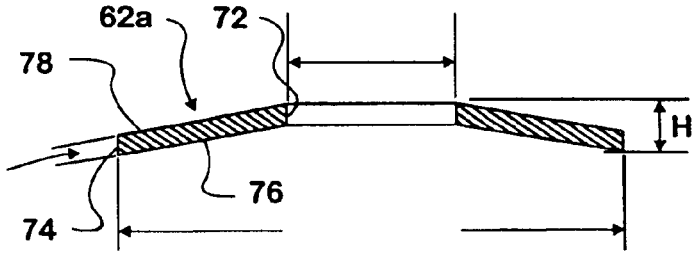
FIG. 4

FUEL INJECTOR RETAINER ASSEMBLY

TECHNICAL FIELD

The present invention is a retainer assembly. More particularly, the present invention is a retainer assembly for retaining a fuel injector in a cylinder head.

BACKGROUND OF THE INVENTION

Certain fuel injectors experience some external as well as internal loading which cause the injector to translate along the longitudinal axis of the injector relative to the cylinder head when the injector is installed in the cylinder head. Currently, certain fuel injectors are retained in the cylinder head by means of a very stiff clamping mechanism. The current clamping mechanism is not damped in any way. The clamping mechanism permits the fuel injector to oscillate back and forth along the fuel injector longitudinal axis. Such oscillations cause objectionable audible noise to be generated.

There is a need in the industry then for a fuel injector retainer assembly that dampens the longitudinal oscillations of the fuel injector and thereby minimizes audible noise generated by such oscillations.

SUMMARY OF THE INVENTION

The fuel injector of the present invention substantially meets the aforementioned needs of the industry. The fuel injector is retained by a retaining mechanism that is damped by means of a viscous damping coupling. The fuel injector, when loaded, tends to move downward along a fuel injector longitudinal axis into a cylinder head deck. This is the same direction that the clamping mechanism is securing the fuel injector to the cylinder head. The retainer assembly of the present invention uses a spring component in conjunction with a split dowel to pre-load the fuel injector/cylinder head joint with a reactive force in opposition to the securing force exerted by the clamping mechanism. The split dowel bottoms out in static engagement with the cylinder head to immobilize the split dowel as the fuel injector is clamped to the cylinder head. Additional clamping force causes the split dowel to bear on and compress the spring component, generating a reactive force. The reactive force is then transmitted by the spring component into the injector in opposition to the clamping force.

Two further forces may assist in restraining the longitudinal translation of the loaded fuel injector. As the fuel injector translates downward into the cylinder head, the fuel injector must slide along the inside diameter (the inner margin) of the split dowel. Frictional force generated between the fuel injector and the inside margin of the split dowel resists the downward translation of the fuel injector. Further, a film of fluid, preferably engine oil, may exist between the inner margin of the dowel and the outer margin of the fuel injector housing. Longitudinal translation of the fuel injector relative to the split dowel generates a significant viscous force that opposes and dampens the fuel injector's translatory motion. The result is that the force exerted by the fuel injector into the cylinder head is greatly reduced resulting in minimizing the audible noise generated by the downward translatory motion of the loaded fuel injector.

The present invention is a fuel injector, the fuel injector being operably couplable to a cylinder head, a clamping mechanism being in operable engagement with the fuel injector and the cylinder head for exerting a clamping force tending to hold the fuel injector in engagement with the cylinder head and includes a retainer assembly for retaining the fuel injector in operable coupling with a cylinder head, the retainer acting in cooperation with the clamping mechanism. The retainer assembly has a split dowel, the split dowel being statically engagable with the cylinder head by a clamping action of the clamping mechanism acting on the fuel injector and being engagable with a spring component for imparting a bias to the spring component. The spring component is in operable engagement with the fuel injector for imparting a reactive force to the fuel injector responsive to the bias imparted by the split dowel. And further including a friction coupling, the friction coupling fluidly coupling the split dowel and the fuel injector for generating a frictional force between the split dowel and the fuel injector, the frictional force tending to resist motion of the fuel injector relative to the cylinder head. The present invention is further a retainer assembly as indicated above and a method of resisting relative motion between a fuel injector and a cylinder head are further included.

DETAILED DESCRIPTION OF THE DRAWINGS

FIG. 1 is sectional view of a fuel injector clamped to a cylinder head and retained by the retainer assembly of the present invention;

FIG. 4 is a sectional view of a Belleville washer;

FIG. 6 is a perspective view of the split dowel.

DETAILED DESCRIPTION OF THE DRAWINGS

Figure 2:
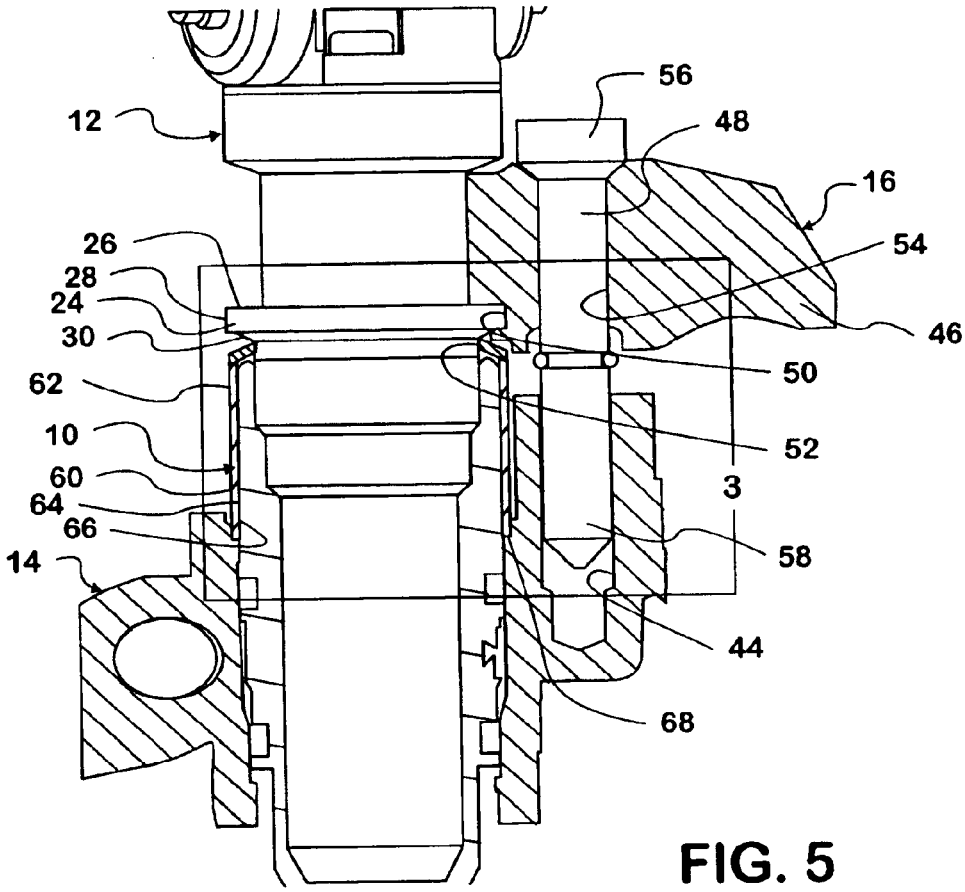
FIG. 2 is an enlarged view of the area within the box 2 of FIG. 1.
Figure 3:
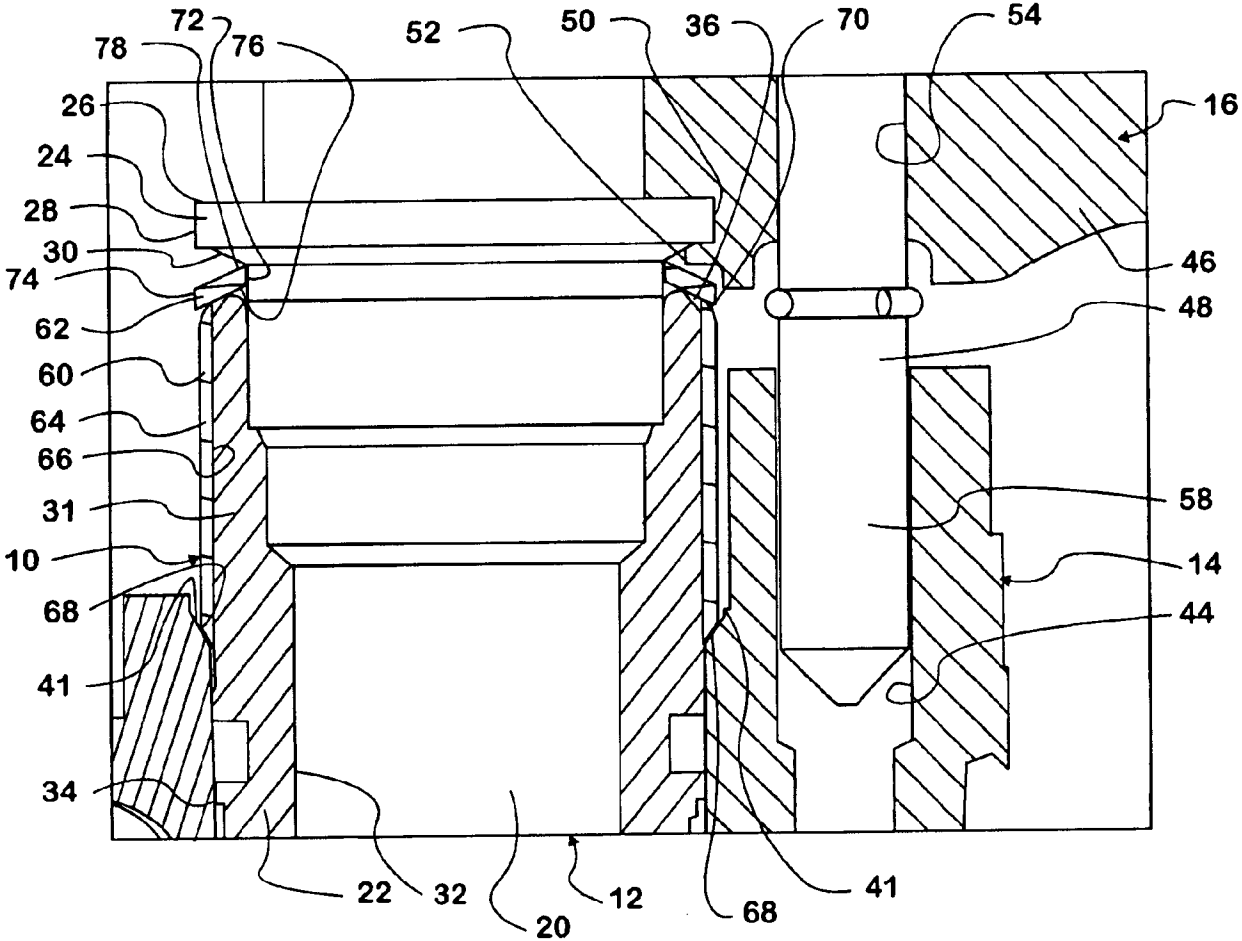
FIG. 3 is an enlarged view of the area within the box 3 of FIG. 2.

The fuel injector retainer assembly of the present invention is shown generally at 10 in FIGS. 1–3. The retainer assembly 10 is depicted in combination with an injector 12, a cylinder head 14, and a clamping mechanism 16.

The injector 12 is preferably a hydraulically-actuated fuel injector (HEUI) that includes an injector body having a nozzle chamber, a nozzle outlet, an activation fluid inlet, an activation fluid drain, an activation fluid cavity, and a pressure relief passage extending between the actuation fluid cavity and the actuation fluid drain. A hydraulic intensifier, including an actuation fluid control valve mounted within the injector body, is used for pressurizing fuel in the nozzle chamber. A needle valve is mounted to reciprocate in the nozzle chamber between an open position in which the nozzle outlet is open and a closed position in which the nozzle outlet is closed. The HEUI type injector utilizes high pressure actuation fluid, preferably engine lubricating oil, to internally pressurize the fuel for injection. At the end of an injection event, spent actuation fluid is discharged from the fuel injector through the actuation fluid drain to an oil gallery defined on the cylinder head. HEUI type injectors are disclosed in U.S. Pat. No. 5,460,329 to Sturman and U.S. Pat. No. 5,682,858 to Chen et al., incorporated herein by reference. While the present invention is described with reference to HEUI type injectors, the retainer assembly of the present invention is applicable to many other types of injectors as well, with the caveat that a source of fluid must be available to define a fluid coupling between the retainer assembly and the fuel injector housing where such fluid coupling is desired.

The fuel injector 12 has a fuel injector body 20 that resides within a fuel injector lower housing 22. The fuel injector 12 has a longitudinal axis 23.

The fuel injector body 20 has an annular clamping ridge 24 presented thereon. The clamping ridge 24 has a ridge upper surface 26 joined to a ridge circumferential surface 28, in turn, joined to a ridge tapered lower surface 30.

The fuel injector lower housing 22 has a housing body 31. The housing body 31 includes an inner margin 32 defining a stepped bore for receiving the fuel injector body 20 therein. The housing body 31 has an outer margin 34 that is generally cylindrical in shape. The housing body 31 has an upper margin 36 and an opposed lower face 38 defining an injection aperture in the housing body 31.

The cylinder head 14 includes an injector bore 40 defined therein for receiving the fuel injector lower housing 22. A beveled face 41 is defined in the bore 40. At the lower extremity of the injector bore 40, an injection aperture 42 is defined that extends between the fuel injector 12 and an engine combustion chamber (not shown).

The cylinder head 14 further includes a blind threaded bore 44. The bore 44 preferably has a longitudinal axis that is parallel to the longitudinal axis 23 of the fuel injector 12 and spaced apart therefrom.

The clamping mechanism 16 generally includes a clamping wedge 46 and a bolt 48. The wedge 46 has a ridge engaging notch 50 defined therein. A lip 52 protrudes below the ridge engaging notch 50 and cooperates to define the ridge-engaging notch 50. A bore 54 is defined through the wedge 46.

The bolt 48 of the clamping mechanism 16 is designed to be slidably engaged with the bore 54. The bolt 48 includes a bolt head 56 that bears on a tapered upper margin of the bore 54 and a threaded shank 58 that is designed to extend into and be threadably engaged with the blind threaded bore 44 defined in the cylinder head 14.

The fuel injector retainer assembly 10 of the present invention includes a split dowel 60 and a spring component 62.

The split dowel 60 of the retainer assembly 10 has a tubular body 64. The tubular body 64 has a generally cylindrical inner margin that has an inside dimension designed to be received exterior to a portion of the outer margin 34 of the lower housing 22. The tolerances between the inner margin 66 of the split dowel 60 and the outer margin 34 of the lower housing 22 are such that there is preferably tight physical contact between the split dowel 60 and the lower housing 22. Further, and there is a minimal void defined between the inner margin 66 of the split dowel 60 and the outer margin 34 of the lower housing 22. The split dowel 60 further has an upper margin 70 that is designed to be brought into compressive engagement with the Belleville washer 62.

Preferably, the split dowel 60 is formed of spring steel. The split dowel 60 has a single longitudinal split 71 (see FIG. 6) that extends longitudinally through the split dowel 60. In production, the inside diameter of the split dowel 60 may be made slightly less than the outside diameter of the outer margin 34 of the lower housing 22. In this manner, the split dowel 60 may be closely engaged with the outer margin 34 of the lower housing 22 to define a close clamping frictional fit. In such arrangement, there is a slight gap generated between the edges of the split dowel 60 that define the split 71.

As depicted in FIGS. 1–4, the spring component 62 is a Belleville washer 62*a*. The Belleville washer 62*a* is a washer in the form of a cone, having preferably constant material thickness and used as a compression spring. Unlike compression springs however, Belleville washers have a unique ability to provide high loads in restricted spaces.

The Belleville washer 62*a* has an inner margin (I.D.) that is sized to receive the outer margin of the injector body 20 immediately beneath the clamping ridge 24. The Belleville washer 62*a* further has an outer margin (O.D.), an underside margin 76 and an upper side margin 78.

Figure 5:
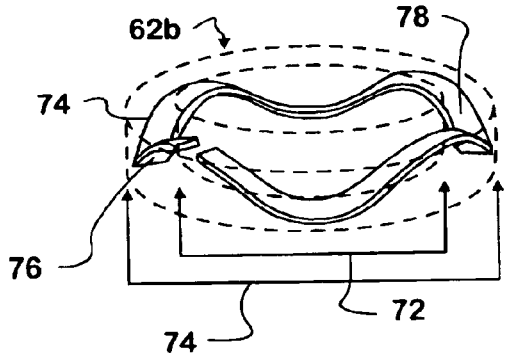
FIG. 5 is a perspective view of a wavy washer.

An alternative spring component 62 to the Belleville washer 62*a* is the wavy washer 62*b* depicted in FIG. 5. The wavy washer 62*b* has the same features as described above with reference to The Belleville washer 62*a*. The wavy washer 62*b* is shown with a flat cross section, but may be also produced with a round cross section. Wavy washers 62*b* as depicted in FIG. 5 may be procured from the Smalley Steel Wing Company of Wheeling, Ill.

In assembly, the spring component 62, the Belleville washer 62*a* or the wavy washer 62*b*, is slid onto the body 20 of the injector 12 until the spring component 62 comes in contact with the ridge tapered lower surface 30. The split dowel 60 is then forced slightly open at the split 71 and snapped into compressive, frictional engagement with the outer margin 34 of the lower housing 22. The lower housing 22 may be then threaded onto the body 20 of the injector 12.

The injector 12, assembled as indicated above, is then placed into the injector bore 40 defined in the cylinder head 14. The clamping mechanism 16 is engaged with the clamping ridge 24 defined on the body 20 of the injector 12. The bolt 48 is aligned with and started into the blind threaded bore 44 defined in the cylinder head 14.

As the bolt 48 is tightened, the beveled lower margin 68 of the split dowel 60 bottoms out on the beveled face 41 defined in the injector bore 40 of the cylinder head 14. Further tightening of the bolt 48 brings the upper margin 70 of the split dowel 60 into contact with the underside margin 76 of the spring component 62 (either the Belleville washer 62*a* or the wavy washer 62*b*), compressing the spring component 62. The spring component 62 in turn transmits this compression as a reactive force to the injector 12. Reactive force acts in opposition to the clamping force imposed on the fuel injector 12 by the clamping mechanism 16 as the bolt 48 is threaded into the bore 44. The reactive force effectively preloads the injector 12 with an upward directed bias.

Internally generating injectable fuel pressure in a HEUI injector results in a relatively high frequency jack hammering effect in the injector 12 that tends to translate the injector 12 longitudinally downward into the cylinder head 14. As indicated above, the HEUI type injector expels actuating fluid (preferably engine lubricating oil) during operation. The actuating fluid washes the exterior of the injector 12 and seeps into the minimal void that exists between the inner margin 66 of the split dowel 60 of the outer margin 34 of the lower housing 22 of the injector 12. The actuating fluid develops a viscous force that resists and dampens the translational motion of the injector 12. It should also be noted that there is also substantial friction existing between the inner margin 66 of the split dowel 60 and the outer margin 30 of the lower housing 22. Even without the effect of the viscous dampening force, the frictional force generated between the split dowel 60 and the injector 12 acts to substantially dampen the longitudinal translation of the injector 12. It should further be noted that any downward translation of the injector 12 acts to increase the reactive force imposed by the Belleville washer 62/wavy washer 62A on the injector 12 as the spring component 62 is further compressed by the split dowel 60.

According, downward translational motion along the longitudinal axis 23 of the injector 12 is resisted and dampened by the reactive force imposed by the Belleville washer 62/wavy washer 62A on the injector 12 and the frictional force developed between the inner margin 66 of the split dowel 60 and the outer margin 34 of the lower housing 22. A further force, being a viscous dampening force, may be generated by a thin film of fluid that is interposed in the small void that exists between the split dowel 60 and the lower housing 22.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A retainer assembly for retaining a fuel injector in operable coupling with a cylinder head, the retainer acting in cooperation with a clamping mechanism, the clamping mechanism being in operable engagement with the fuel injector and the cylinder head for exerting a clamping force tending to hold the fuel injector in engagement with the cylinder head, comprising:

first retainer means being statically engagable with the cylinder head by a clamping action of the clamping mechanism acting on the fuel injector and being engagable with a second retainer means for imparting a bias to the second retainer means;

the second retainer means being in operable engagement with the fuel injector for imparting a reactive force to the fuel injector responsive to the bias imparted by the first retainer means; and frictional coupling means frictionally coupling the first retainer means and the fuel injector for generating a frictional force between the first coupling means and the fuel injector, the frictional force tending to resist motion of the fuel injector relative to the cylinder head.

2. The retainer assembly of claim 1 wherein the reactive force and the frictional force act substantially parallel to a fuel injector longitudinal axis.

3. The retainer assembly of claim 1 wherein the frictional force is augmented by viscous force developed between the first retainer means and the fuel injector.

4. The retainer assembly of claim 1 wherein the first retainer means is a split dowel and the second retainer means is a spring component, being a Belleville washer or a wavy washer.

5. The retainer assembly of claim 4 wherein the split dowel has a first margin, an opposed second margin, and an injector receiver bore defined interior to a dowel wall.

6. The retainer assembly of claim 5 wherein the fuel injector is receivable within the injector receiver bore and the first margin being statically engagable with a cylinder head surface.

7. The retainer assembly of claim 6 wherein the second margin of the split dowel has a diameter that is slightly less than the diameter of an outer circumferential margin of the spring component, the split dowel second margin being engagable in compressive engagement with the spring component proximate the spring component outer circumferential margin.

8. The retainer assembly of claim 7 wherein the spring component has an inner circumferential margin, the spring component being engagable in compressive engagement with a fuel injector surface proximate the spring component inner circumferential margin.

9. The retainer assembly of claim 1 wherein a void is defined between the first retainer means and the fuel injector.

10. The retainer assembly of claim 9 wherein the void is open to being filled by engine lubricating oil, the engine lubricating oil being the fluid coupling means.

11. A retainer assembly for retaining a fuel injector in operable coupling with a cylinder head, the retainer acting in cooperation with a clamping mechanism, the clamping mechanism being in operable engagement with the fuel injector and the cylinder head for exerting a clamping force tending to hold the fuel injector in engagement with the cylinder head, comprising:

a split dowel, the split dowel being statically engagable with the cylinder head by a clamping action of the clamping mechanism acting on the fuel injector and being engagable with a spring component for imparting a bias to the spring component;

the spring component being in operable engagement with the fuel injector for imparting a reactive force to the fuel injector responsive to the bias imparted by the split dowel; and a friction coupling, the friction coupling fluidly coupling the split dowel and the fuel injector for generating a frictional force between the split dowel and the fuel injector, the frictional force tending to resist motion of the fuel injector relative to the cylinder head.

12. The retainer assembly of claim 11 wherein the reactive force and the frictional force act substantially parallel to a fuel injector longitudinal axis.

13. The retainer assembly of claim 11 wherein the frictional force is augmented by viscous force developed between the first retainer means and the fuel injector.

14. The retainer assembly of claim 13 wherein the reactive force, the viscous force and the frictional force act in cooperation to resist motion of the fuel injector relative to the cylinder head along the fuel injector longitudinal axis.

15. The retainer assembly of claim 14 wherein the split dowel has a first margin, an opposed second margin, and an injector receiver bore defined interior to a dowel wall.

16. The retainer assembly of claim 15 wherein the fuel injector is receivable within the injector receiver bore and the first margin being statically engagable with a cylinder head surface.

17. The retainer assembly of claim 16 wherein the second margin of the split dowel has a diameter that is slightly less than the diameter of an outer circumferential margin of the spring component, the split dowel second margin being engagable in compressive engagement with the spring component proximate the spring component outer circumferential margin.

18. The retainer assembly of claim 17 wherein the spring component has an inner circumferential margin, the spring component being engagable in compressive engagement with a fuel injector surface proximate the spring component inner circumferential margin.

19. The retainer assembly of claim 11 wherein a void is defined between the split dowel and the fuel injector.

20. The retainer assembly of claim 19 wherein the void is open to being filled by engine lubricating oil, the engine lubricating oil being the fluid coupling means.

21. A fuel injector being operably couplable to a cylinder head, a clamping mechanism being in operable engagement with the fuel injector and the cylinder head for exerting a clamping force tending to hold the fuel injector in engagement with the cylinder head, comprising:

a retainer assembly for retaining the fuel injector in operable coupling with a cylinder head, the retainer acting in cooperation with the clamping mechanism, the retainer assembly having;

a split dowel, the split dowel being statically engagable with the cylinder head by a clamping action of the clamping mechanism acting on the fuel injector and being engagable with a spring component for imparting a bias to the spring component;

the spring component being in operable engagement with the fuel injector for imparting a reactive force to the fuel injector responsive to the bias imparted by the split dowel; and a friction coupling, the friction coupling fluidly coupling the split dowel and the fuel injector for generating a frictional force between the split dowel and the fuel injector, the frictional force tending to resist motion of the fuel injector relative to the cylinder head.

22. The fuel injector of claim 21 wherein the reactive force and the frictional force act substantially parallel to a fuel injector longitudinal axis.

23. The fuel injector of claim 21 wherein the frictional force is augmented by viscous force developed between the first retainer means and the fuel injector.

24. The fuel injector of claim 23 wherein the reactive force, the viscous force and the frictional force act in cooperation to resist motion of the fuel injector relative to the cylinder head along the fuel injector longitudinal axis.

25. The fuel injector of claim 24 wherein the split dowel has a first margin, an opposed second margin, and an injector receiver bore defined interior to a dowel wall.

26. The fuel injector of claim 25 wherein the fuel injector is receivable within the injector receiver bore and the first margin being statically engagable with a cylinder head surface.

27. The fuel injector of claim 26 wherein the second margin of the split dowel has a diameter that is slightly less than the diameter of an outer circumferential margin of the spring component, the split dowel second margin being engagable in compressive engagement with the spring component proximate the spring component outer circumferential margin.

28. The fuel injector of claim 27 wherein the spring component has an inner circumferential margin, the spring component being engagable in compressive engagement with a fuel injector surface proximate the spring component inner circumferential margin.

29. The fuel injector of claim 21 wherein a void is defined between the split dowel and the fuel injector.

30. The fuel injector of claim 29 wherein the void is open to being filled by engine lubricating oil, the engine lubricating oil being the fluid coupling means.

* * * * *